United States Patent [19]

Stanzel

[11] Patent Number: 4,573,937

[45] Date of Patent: Mar. 4, 1986

[54] JET PROPELLED MODEL AIRPLANE

[76] Inventor: Victor Stanzel, P.O. Box 28, Schulenburg, Tex. 78956

[21] Appl. No.: 632,388

[22] Filed: Jul. 19, 1984

[51] Int. Cl.[4] ..... A63H 27/04

[52] U.S. Cl. ..... 446/31; 446/56

[58] Field of Search ..... 446/30, 31, 33, 36, 446/37, 38, 39, 247, 56; 310/74, 62

[56] References Cited

U.S. PATENT DOCUMENTS

| | | | |
|---|---|---|---|
| 3,019,555 | 2/1962 | Poticha | 446/37 |
| 3,732,645 | 5/1973 | Winston | 446/38 |
| 3,790,831 | 2/1974 | Morreale | 310/74 |
| 3,919,805 | 11/1975 | Stanzel | 446/33 |
| 3,937,103 | 2/1976 | Kleinhans | 310/74 |
| 3,959,677 | 5/1976 | Grieb | 310/62 |
| 4,133,139 | 1/1979 | Stanzel | 446/31 |

*Primary Examiner*—Robert A. Hafer

*Assistant Examiner*—Daniel Nolan

*Attorney, Agent, or Firm*—Vinson & Elkins

[57] ABSTRACT

A line-controlled, centrifugal fan, jet-propelled model airplane is disclosed in which the impeller of a fan contained within the fuselage of the aircraft is driven from a remote drive unit by an elongated flexible cable contained within a flexible sheath. The impeller rotates about an axis perpendicular to the longitudinal axis of the airplane and is driven in a direction of rotation tending to rotate the airplane about its lateral axis in a nose-up direction, due to the frictional contact of the compressed air between the rotating impeller and the housing of the centrifugal fan mounted within the fuselage. A flywheel powered by the electric motor in the remote drive unit controls the rate of acceleration and deceleration of the aircraft as an electric motor in the drive unit is switched on and off.

12 Claims, 4 Drawing Figures

Fig. 3
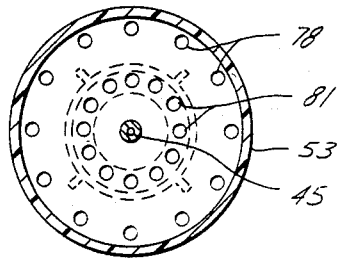
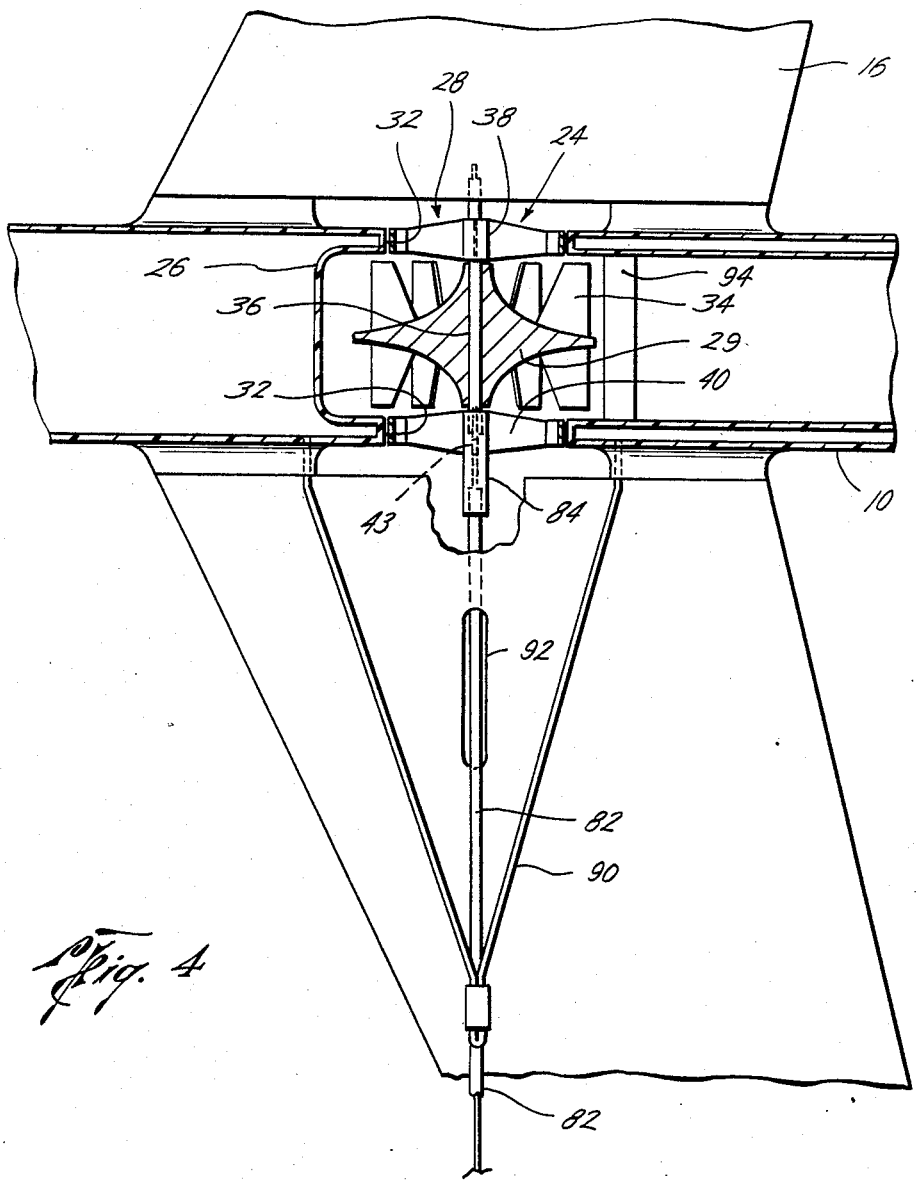
Fig. 4

JET PROPELLED MODEL AIRPLANE

BACKGROUND OF THE INVENTION

I. Field of the Invention

This invention relates to toy or model aircraft of the type which are remotely powered and remotely controlled in flight and more particularly to a line-controlled model airplane having as its motive power a centrifugal fan ejecting a stream of air rearwardly for reactive forward jet propulsion.

II. Description of the Prior Art

U.S. Pat. Nos. 4,133,139, 3,018,585 and 3,919,805 disclose prior art remotely powered and controlled model aircraft somewhat similar to those of the present invention, but not possessing the improvements of the present invention.

SUMMARY OF THE INVENTION

This invention relates to improvements in remotely powered and controlled model aircraft of the general type disclosed in U.S. Pat. Nos. 4,133,139, 3,018,585 and 3,919,805 wherein the aircraft is powered from a remotely located motor through an elongated flexible drive shaft or cable confined within an elongated flexible sheath or housing. Like the prior art aircraft shown in U.S. Pat. No. 4,133,139, the present aircraft is jet propelled by means of a centrifugal fan mounted within the fuselage of the aircraft, the impeller of the fan being driven by the flexible drive shaft from the remotely located motor.

In the prior art aircraft as shown in U.S. Pat. No. 4,133,139, the remotely located drive motor includes electrical resistance-type speed control means for the motor to vary the rotational speed of the impeller. In practice, operation of the electric resistance-type speed control means has proven difficult for children who are the primary users of these toy aircraft. Additionally, such resistance-type variable speed control is relatively expensive for use on toy aircraft and is somewhat more subject to breakage or failure than is an on-off contact switch. A simple on-off electrical contact switch therefore is more desirable for a variety of reasons. However, with an on-off switch, the very rapid speedup of the motor and impeller once it is switched on, and the rapid deceleration once it is switched off, would not provide adequately controlled acceleration and deceleration for take-off and landing. Nor would it simulate the sound of a jet engine "powering up" or "powering down" as does the resistance switch.

According to a principal feature of the present invention, the difficulties and expense associated with the resistance-type switch have been eliminated, while preserving controlled acceleration and deceleration of the aircraft for take-off and landing, and simulated jet engine sound, by providing, in conjunction with the electric motor, a weighted flywheel, the inertia of which will cause the electric motor, and thereby the flexible drive shaft and impeller, to accelerate and decelerate at controlled rates while the electric motor is operated by a simple two position on-off electrical contact switch.

According to another aspect of the invention, means are provided for circulating cooling air through the housing of the remote drive unit for cooling the electric motor when it is in operation.

DESCRIPTION OF THE DRAWINGS

In the accompanying drawings, which form a part of the application and in which like numerals indicate like parts:

FIG. 3 is a sectional view taken along lines 3—3 of FIG. 2 illustrating the preferred configuration of air circulation holes in the housing of the remote drive unit; and FIG. 4 is a plan view, partly in section, of a portion of the fuselage of the aircraft of FIG. 1, illustrating details of the centrifugal fan and impeller and of the connection of the flexible drive shaft and its sheath to the aircraft and to the impeller of the centrifugal drive fan.

DESCRIPTION OF THE PREFERRED EMBODIMENT

Figure 1:
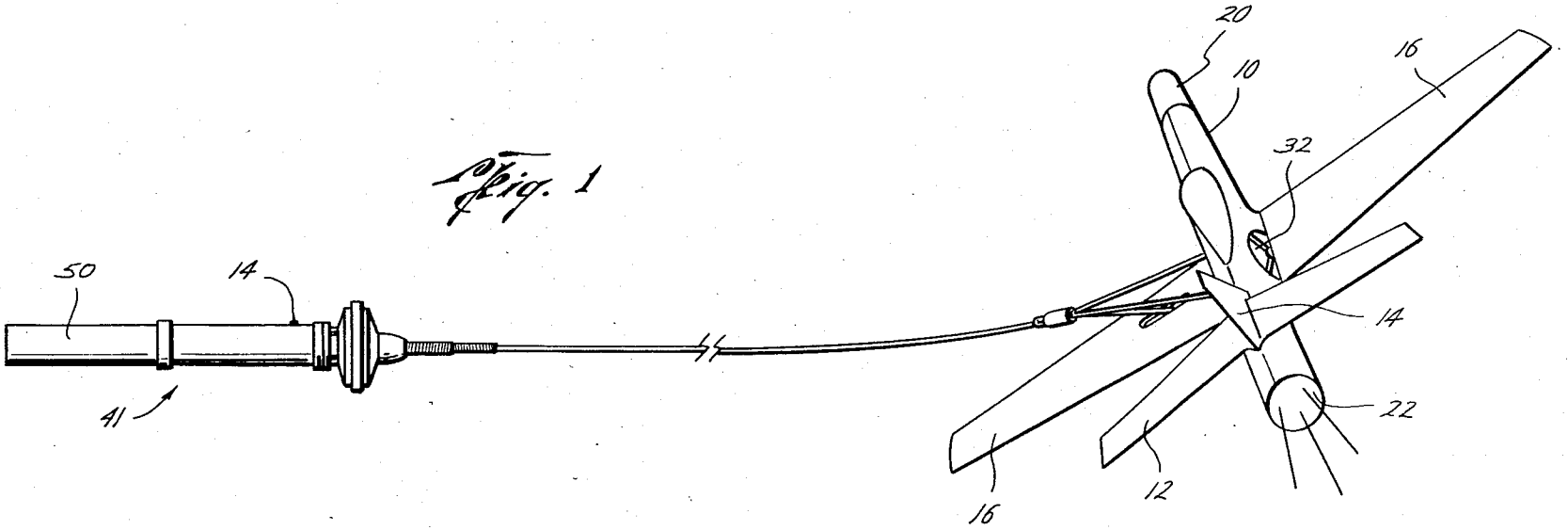
FIG. 1 is a perspective view, illustrating the preferred embodiment of the present invention including the aircraft, the remote drive unit and the connecting flexible drive cable.
Figure 2:
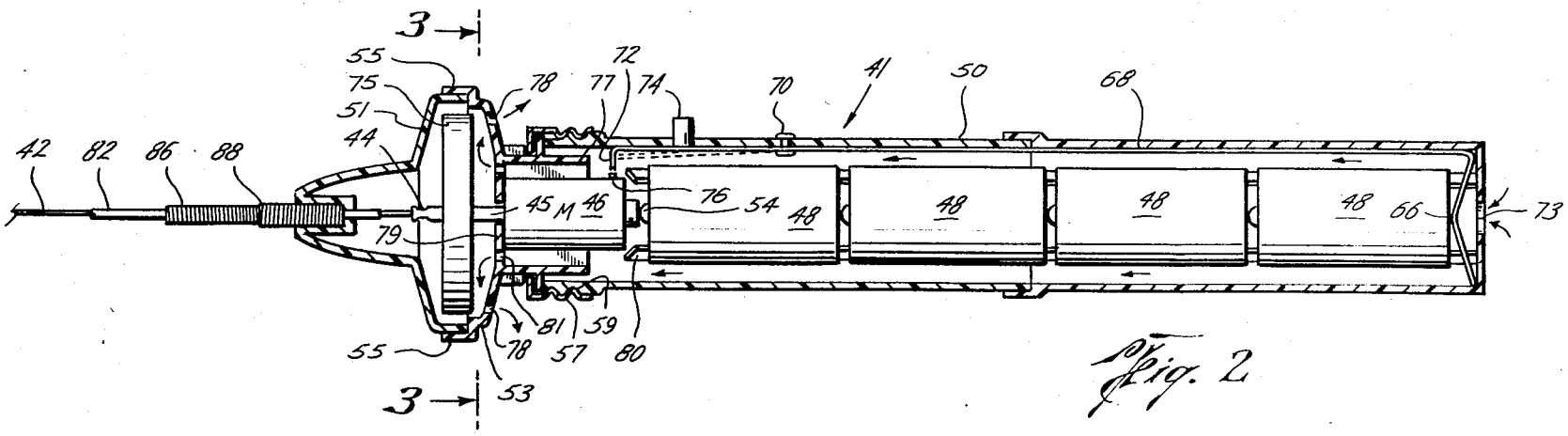
FIG. 2 is an elevational view, partly in section, illustrating details of the remote drive unit.

Referring now to FIG. 1, there is shown a model aircraft having a hollow body or fuselage 10, a tail assembly including stabilizers 12 and rudder 14 and wings 16. Conventional landing gear (not shown) is provided for take-off and landing.

The airplane preferably is of very light construction and intended to be aerodynamically self-supporting at relatively low airspeeds. Accordingly, durable but lightweight materials are used in constructing the aircraft with the body 10 and rudder 14 being integrally formed of hollow molded plastic. The wings 16 and stabilizers 12 of the tail assembly are preferably of balsa wood laminated between surface layers of paper. The front end of the fuselage is fitted with a resilient foam nose piece 20 to absorb shock or frontal impact and for safety purposes. A simulated jet exhaust opening 22 is formed at the tail end of the fuselage.

Fan means 24 are housed within the fuselage for powering the aircraft. These preferably comprise a streamlined fan housing 26 and a two-sided impeller 28. The fan housing 26 is fitted into approximately the mid or center section of the fuselage 10 and has an outlet directed rearwardly and connected with the jet exhaust opening 22 at the rear of the fuselage. Circular air intake openings 32 are provided on each side of the fan housing 26. Corresponding air inlet openings are provided in the fuselage 10. As is apparent, the fan housing 26 could, if desired, be formed integrally with the hollow fuselage 10.

The impeller 28 has a generally circular central or body portion 29 with a plurality of vanes or blades 34 mounted perpendicularly thereto and extending outwardly on each side of the central portion 29. The impeller 28 is mounted for rotation about an axis perpendicular to the longitudinal axis of the aircraft body on a small diameter tubular shaft 36. Shaft 36 is rotatably mounted in bearings 38 which are centered in the air intake openings 32 by means of centering struts 40.

The impeller 28 is driven by means of a remote drive unit 41 through a flexible drive shaft or cable 42. Drive shaft 42 has one end suitably connected to the tubular impeller shaft 36, as by swaging 43, so that the impeller 28 will rotate one revolution for each revolution of the flexible drive shaft 42. The opposite end of the flexible drive shaft 42 is suitably connected, as by connector 44, to the drive shaft 45 on an electric motor 46 in the remote drive unit 41. Power for the motor 46 is provided by a plurality of flashlight-type batteries 48. The electric motor 46 and batteries 48 are contained within an elongated cylindrical housing 50 which also serves as the control handle for the airplane.

Releasably attached to the front end of the cylindrical housing 50 is a flywheel housing comprising a forward flywheel housing 51 and a rear flywheel housing 53. The two flywheel housing parts preferably are made of plastic and are adhesively joined together along cylindrical joint 55. The electric motor 46 is suitably mounted on the back side of rear flywheel housing 53 as by adhesive bonding. The drive shaft 45 extends through an opening in the rear flywheel housing 53 and has mounted thereon the flywheel 75.

A metal screw ring 57 is attached to the rear flywheel housing, as by swaging, and holds the rear flywheel housing 53 onto the forward end of the cylindrical housing 50 by engaging mating threads 59 formed in the wall of the cylindrical housing 50. With this construction, the flywheel housing with the attached drive assembly, including the motor 46, drive shaft 45, flywheel 75 and flexible drive shaft 42 may be selectively disengaged from the cylindrical housing 50 for placement and replacement of the batteries 48.

Details of construction of the electric motor and power pack of the remote drive unit 41 are disclosed more fully in U.S. Pat. No. 3,018,585. One terminal of the electric motor 46 is electrically connected to the batteries 48 by a connector button 54. The other motor terminal is adapted for electrical connection to the battery base terminal 66 by means of flexible electric conductor 68 which extends from the base terminal 66 along the inside of the housing 50. The conductor 68 preferably is made of a flexible electrically conductive metal, such as brass, and is fastened to the housing 50 near its upper end as by rivet 70. The free end of the conductor 68 nearest the motor 46 has a right angle bend so that the tip portion 72 of the conductor 68 is adapted, when depressed by button 74 extending through the housing 50, to engage a conductor 76 on the housing of the electric motor 46, thereby completing the electric circuit and switching on the motor 46. The resilience of the conductor 68 will cause the conductor to return to its raised position, and break the electric circuit, as soon as the button 74 is released.

A flywheel 75, preferably of metal, is provided on the drive shaft 45 of the electric motor 46 to control the rate of acceleration and deceleration of the electric motor 46. The inertia of the stationary flywheel 75 will retard the rate the acceleration of the drive shaft 45, and flexible drive shaft 42, when the motor is first switched on and starts spinning, to thereby cause the fan means 24 of the aircraft to accelerate at a slower rate of speed during take-off of the aircraft, and to simulate the start-up sound of a jet engine. Conversely, when the button 74 is released, breaking the electric circuit to the motor 46, energy stored in the rotating flywheel 75 will control the rate of deceleration of the fan means 24 to permit a controlled powered landing of the aircraft and to more closely simulate the "powering down" phase of operation of a jet engine.

Means preferably are provided in conjunction with the remote drive unit 41 for circulating cooling air around the motor 46 while the motor is in operation to remove excess heat generated by the motor and thereby prolong the life of the motor. These means preferably comprise an air inlet opening 73 in the base of the housing 50, an annular air circulation passageway 77 extending through the interior of the housing 50 and in surrounding relationship to the electric motor 46 and batteries 48, and a plurality of air outlet openings 78 in the rear flywheel housing 53. A plurality of air circulation openings 81 are provided in the rear wall of the rear flywheel housing 53 in surrounding relationship to the motor 46 to permit air to circulate from the air circulation passageway 77 into the interior of the flywheel housing.

Means are provided for inducing circulation of air from the exterior of the housing 50, in through the inlet opening 73, through the air circulation passageway 77 around the motor 46 and batteries 48, through the openings 81, and out through the exit openings 78 when the motor 46 is in operation. Preferably these comprise the rotating flywheel 75 which, since it is mounted in the flywheel housing with close clearances at its outer edge, will frictionally engage air inside the flywheel housing as it spins. The spinning flywheel 75 will drive the air outwardly due to centrifugal force, so that the air will circulate in through openings 81 and out through openings 78 to set up the desired circulation. If desired for greater air circulation, small impellers could, of course, be added to the flywheel 75. Since only a modest amount of air circulation is required for cooling of the electric motor 46, this has not proved necessary in practice.

The flexible drive shaft 42 is housed within a flexible tubular sheath 82 one end of which is held centrally in a tubular extension 84 surrounding the impeller axle 36. The other end of the tubular sheath 82 extends into the nose of the drive unit housing 50. Two spiral wound springs 86 and 88 surround the tubular sheath 82 at the point where it enters the housing 50 to prevent sharp bending or kinking of the drive cable at this point. The tubular sheath 82 also is attached to the structure of the airplane by a wire brace 90 from which it extends through an opening 92 in the wing for connection to the fan means 24. Attachment of the flexible tubular sheath 82 to the airplane by means of the wire brace 90 imparts additional lateral stability to the airplane during flight.

With the apparatus thus described, depression of the button 74 on the remote drive unit 41 will result in actuation of the electric motor 46. As the flywheel 75 accelerates from stationary to the designed rotational speed of the motor 46, the rotation of the flexible drive shaft 42 will in turn drive the impeller 28 of the fan 24 to power the aircraft.

It has been found that the rotation of the impeller 28 within the fan housing 26 is effective in transmitting rotative force to the housing and thus to the structure of the airplane into which the housing is fixed, in the same direction of rotation as that of the impeller, due to the friction of the compressed air between the impeller and housing. It has been found, further, that it is important that the impeller be powered to rotate in a direction tending to rotate the airplane in a nose-up direction. For example, viewing the counter-clockwise flying airplane from the center of its flying circle, the impeller should be powered to rotate in a clockwise direction. Thus, under power for the take-off, the nose of the airplane will tend to turn upwardly in a climbing attitude, and with power reduced for a landing, the nose of the airplane will drop for the glide.

It has been found that the provision in the centrifugal fan drive 24 of a vane or projection 94 will cause an interruption of the flow of air and thereby produce a high-pitched sound similar to the sound of a real jet engine.

The foregoing disclosure and description of the invention is illustrative and explanatory thereof, and various changes in the size, shape and material, as well in the details of the illustrated embodiment, may be made within the scope of the appended claims without departing from the spirit of the invention.

What is claimed is:

1. A toy aircraft comprising:

an elongated body having wings and a tail assembly attached thereto;

centrifugal fan means housed within said body for powering said aircraft;

a hand-held remote drive unit for driving said fan means, said remote drive unit comprising, an electric motor, and switch means for selectively operating said electric motor;

an elongated flexible drive cable extending between and operatively connected to said remote drive unit and said centrifugal fan means for rotatively driving said centrifugal fan means from said drive unit; and means for controlling the rate of acceleration of said fan means when said electric motor is switched on and for controlling the rate of deceleration of said fan means when said motor is switched off, said means comprising a flywheel disposed in said hand-held remote drive unit and operatively connected to at least one of said electric motor and said elongated flexible drive cable.

2. The apparatus according to claim 1 comprising additionally, an elongated flexible sheath extending between said airplane body and said remote drive unit in surrounding relationship to said flexible drive cable.

3. The apparatus according to claim 1 wherein said remote drive unit comprises additionally a housing in surrounding relationship to said electric motor and said flywheel and wherein at least one air inlet opening and at least one air outlet opening are provided in said housing for circulation of cooling air around said electric motor.

4. The apparatus according to claim 3 wherein said remote drive unit comprises additionally, means for mounting said electric motor in said housing, an air circulation passageway in said housing in surrounding relationship to said electric motor, and means for inducing circulation of air into said air inlet opening, through said air passageway means in surrounding relationship to said electric motor and out said air outlet opening, to thereby cool said electric motor.

5. The apparatus according to claim 4 wherein said air outlet opening is proximate said flywheel and wherein said flywheel comprises said means for inducing said air circulation.

6. The apparatus according to claim 1 wherein said aircraft body includes air inlet means on said body and air outlet means at the rear of said body simulating a jet engine exhaust outlet, and wherein said fan means comprise, a fan housing within said body and adapted to channel air from said air inlet opening in said body to said air outlet, and centrifugal impeller means mounted within said fan housing for rotation about an axis perpendicular to the longitudinal axis of said aircraft body and operatively connected to said flexible drive shaft, for forcing air from said air inlet in said body, through said fan housing and out of said air outlet of said body to thereby produce the drive thrust for said aircraft.

7. The apparatus according to claim 6 wherein said impeller includes a plurality of vanes extending parallel to its own axis of rotation and perpendicular to the longitudinal axis of said aircraft body.

8. The apparatus according to claim 4 wherein said impeller is adapted to be rotated by said flexible cable and remote drive unit in a direction tending to rotate the airplane about its lateral axis in a nose-up direction.

9. The apparatus according to claim 6 wherein said fan means includes additional air flow interrupter means mounted in said housing for interrupting the flow of air through said housing to thereby simulate the noise of a jet engine.

10. A model aircraft comprising:

a body having at least one air inlet opening on the side thereof, and an air outlet opening on the rear end thereof simulating a jet exhaust;

wings, a tail assembly and landing gear suitably attached to said body;

centrifugal fan means housed within said body and adapted to rotate about an axis perpendicular to the longitudinal axis of the aircraft body to compress air taken in through said air inlet opening and to direct said compressed air rearwardly through said air outlet opening for reactive forward jet propulsion of said aircraft;

a hand-held remote drive unit for powering said fan means, said remote drive unit comprising, an elongated cylindrical housing, a direct current electric motor mounted in said housing, a direct current power supply mounted in said housing and operatively connected by electrical circuit means to said electric motor, a flywheel mounted in said housing and powered by said electric motor, at least one air inlet opening in said housing, at least one air outlet opening in said housing between said flywheel and said motor, and electrical switch means in said housing for completing said electrical circuit means to thereby selectively operate said electric motor; and elongated flexible drive means interconnecting said remote drive unit and said fan means, whereby when said electrical switch means is operated to complete said electrical circuit between said direct current supply and said electric motor, said flywheel will control the acceleration of the rate of rotation of said elongated flexible drive means and said centrifugal fan means to thereby simulate the accelerating sound of a jet engine, and when said electrical switch means is operated to break said electrical circuit between said direct current supply and said electric motor, said flywheel will control the deceleration of the rate of rotation of said elongated flexible drive means and said centrifugal fan means to thereby simulate the powering down phase of operation of a jet engine.

11. The apparatus according to claim 10 wherein the body of said aircraft includes a nose of resilient, shock absorbing material.

12. The apparatus according to claim 10 wherein said fan means is powered in a direction tending to rotate the body of said airplane about its lateral axis in a nose-up direction.

* * * * *